US008500312B2

(12) United States Patent
Kuan

(10) Patent No.: US 8,500,312 B2
(45) Date of Patent: Aug. 6, 2013

(54) LIGHT ASSEMBLY

(76) Inventor: Chuan-Ching Kuan, Taoyuan County (TW)

( * ) Notice: Subject to any disclaimer, the term of this patent is extended or adjusted under 35 U.S.C. 154(b) by 198 days.

(21) Appl. No.: 13/160,695

(22) Filed: Jun. 15, 2011

(65) Prior Publication Data

US 2012/0320597 A1 Dec. 20, 2012

(51) Int. Cl.
*F21V 15/00* (2006.01)

(52) U.S. Cl.
USPC ..... 362/364; 362/365

(58) Field of Classification Search
USPC ..... 362/364–365
See application file for complete search history.

(56) References Cited

U.S. PATENT DOCUMENTS 8,070,328 B1 * 12/2011 Knoble et al. ..... 362/311.02

* cited by examiner

*Primary Examiner* — Diane Lee
*Assistant Examiner* — Sean Gramling
(74) *Attorney, Agent, or Firm* — Rabin & Berdo, P.C.

(57) ABSTRACT

A light assembly includes a fixing unit and a lighting unit located within a lamp cover. The fixing unit includes a substrate board with a recessed shape, and an elastic steel ring is engaged with the hook flange of the substrate board in order to increase the tightness between the substrate board and the lamp cover so as to prevent water vapor and salt mist from entering into the light assembly, and thereby the corrosion of light source and circuit can be avoided. The light emitting diode is used as a light source instead of the conventional halogen lamp.

5 Claims, 7 Drawing Sheets

LIGHT ASSEMBLY

BACKGROUND OF THE INVENTION

1. Field of the Invention

The present invention relates generally to a light assembly, and in particular to a light assembly which can avoid water vapor and salt mist from entering therein.

2. The Prior Arts

The halogen lamp is often used in the conventional light assemblies, and however, the halogen lamp has the following disadvantages:

(1) The halogen lamp has low luminous efficiency, which cost a lot of energy, and this point of view, the halogen lamps do not meet the requirements of energy saving.

(2) The ray of the halogen lamp can concentrate into a single hot spot, which may cause the poison gas to be discharged from the decoration materials (such as wood, and plastics) and the sticky substance therein, and some materials even can be burned at high temperature. Furthermore, the heat produced from the halogen lamp in a room can cause the air conditioner to run longer than necessary.

(3) The halogen lamp has a thickness of 5 cm, which occupy too much space.

(4) The use life of halogen lamp is short, which is about 2000 hours, and when the halogen lamp is used in cabin on ship, the use life is only about 2.8 months if the halogen lamp is operated for 24 hours a day.

(5) The UV light can be irradiated from the halogen lamp, which will cause the aging and deterioration of irradiated materials.

(6) The DC/AC/DC power supply is used for the halogen lamp, which will cause an increase in the DC-AC-DC power conversion loss.

Moreover, the lamp fixture and the substrate board is riveted together, and thereby the damaged components are difficult to be replaced or changed, and thereby the maintenance of the halogen lamp becomes a big burden.

SUMMARY OF THE INVENTION

Accordingly, the objective of the present invention is to provide a light assembly which has the advantages of better sealing, small size and flexible assemble way, and the light assembly of the present invention uses LED as a light source instead of the conventional light source such as the halogen lamp.

To achieve the above objective, the present invention provides a light assembly which comprises: (1) a fixing unit including (i) a frame, wherein a plurality of torsion springs are connected to a side of the frame, and one end of each torsion spring is provided in one of openings in the side of the frame, and a lamp cover having at least one wire hole for allowing the wires to pass therethrough is disposed within the frame; and (ii) a substrate board with a recessed shape disposed at an opening of the frame, wherein the substrate board has an opening formed therein, and an external peripheral of the substrate board has a hook flange, and an elastic steel ring is engaged with the hook flange of the substrate board so that the substrate board can be tightly fastened to the lamp cover; and (2) a lighting unit comprising a light source, a reflection cup, and a diffusion plate, wherein the light source is disposed on the substrate which is disposed in the lamp cover, and a reflection cup is facing downwards mounted on the substrate and surrounds the light source so as to reflect the emitted light of the light source 11, and a diffusion plate is disposed on the top of the reflection cup which is upside down, and wherein the diffusion plate is engaged with the opening of the substrate board, and the substrate board is held in position against the diffusion plate, and the reflection cup is tightly fixed between the diffusion plate and the lamp cover.

The light assembly of the present invention has the following advantages: the components of the light assembly are individually installed and made by different material in view of heat dissipation characteristics thereof; the substrate board with a recessed shape can avoid the light from scattering; the elastic steel ring is used to secure the substrate board so that the substrate board will not become loose by impact or shaking; the assembling process is easy and the color of the substrate board can be easily changed or replaced according to the user's need; the wires are away from water vapor and salt mist to prevent wire corrosion because the wires are disposed within the lamp cover; the fixing unit is coated with anti-corrosion material (not shown) to improve the anti-corrosion performance and also the heat dissipation; the reflection cup reflects the light from the light source and applies a force to the substrate board against the lamp cover; and the structure of the light assembly is air and water tight so that water vapor and salt mist are efficiently kept outside of the light assembly.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
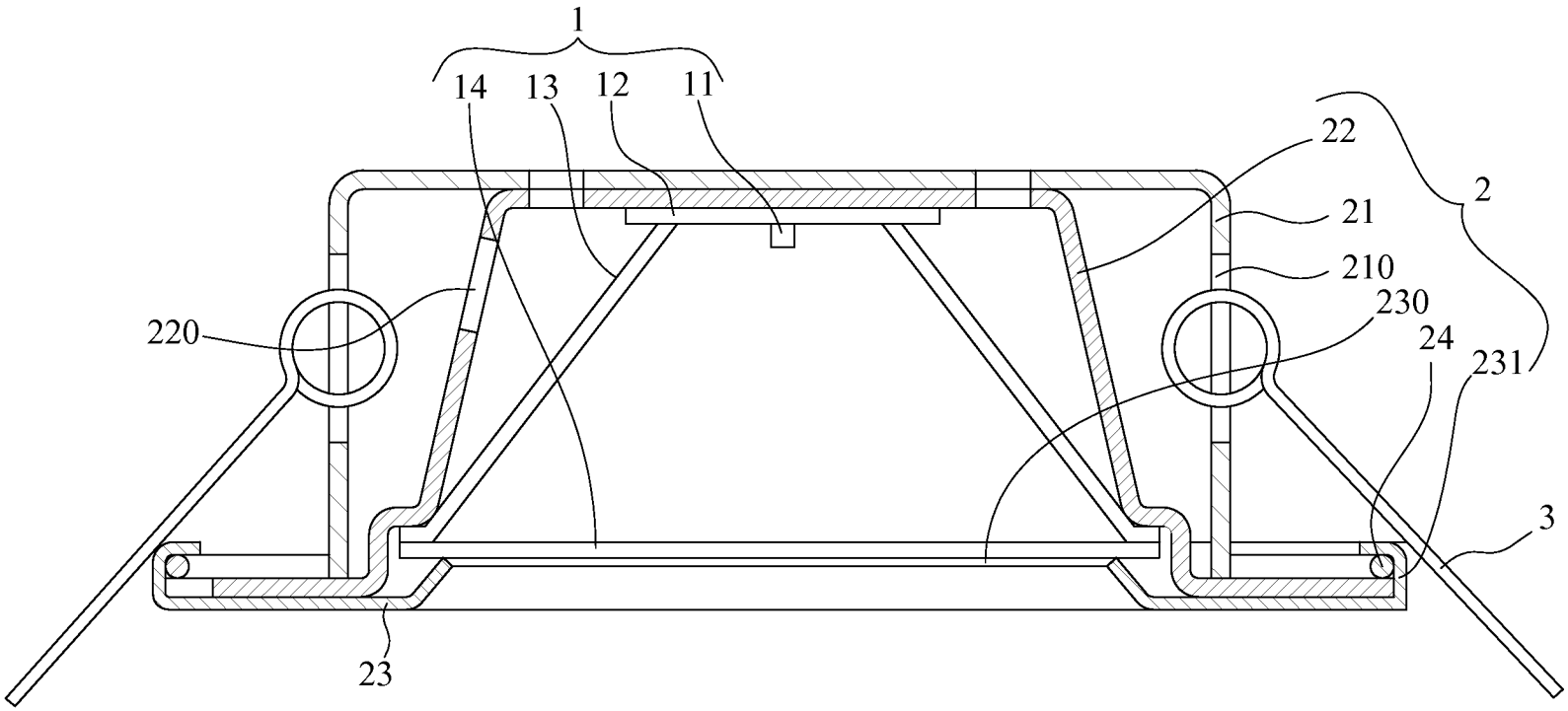
FIG. 1 is a cross sectional view of the light assembly in accordance with one embodiment of the present invention.
Figure 2:
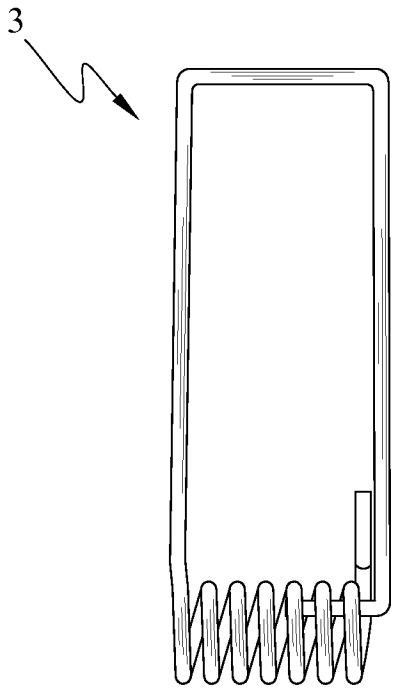
FIG. 2 is a plane view of the torsion spring used in the light assembly in accordance with the present invention.
Figure 3:
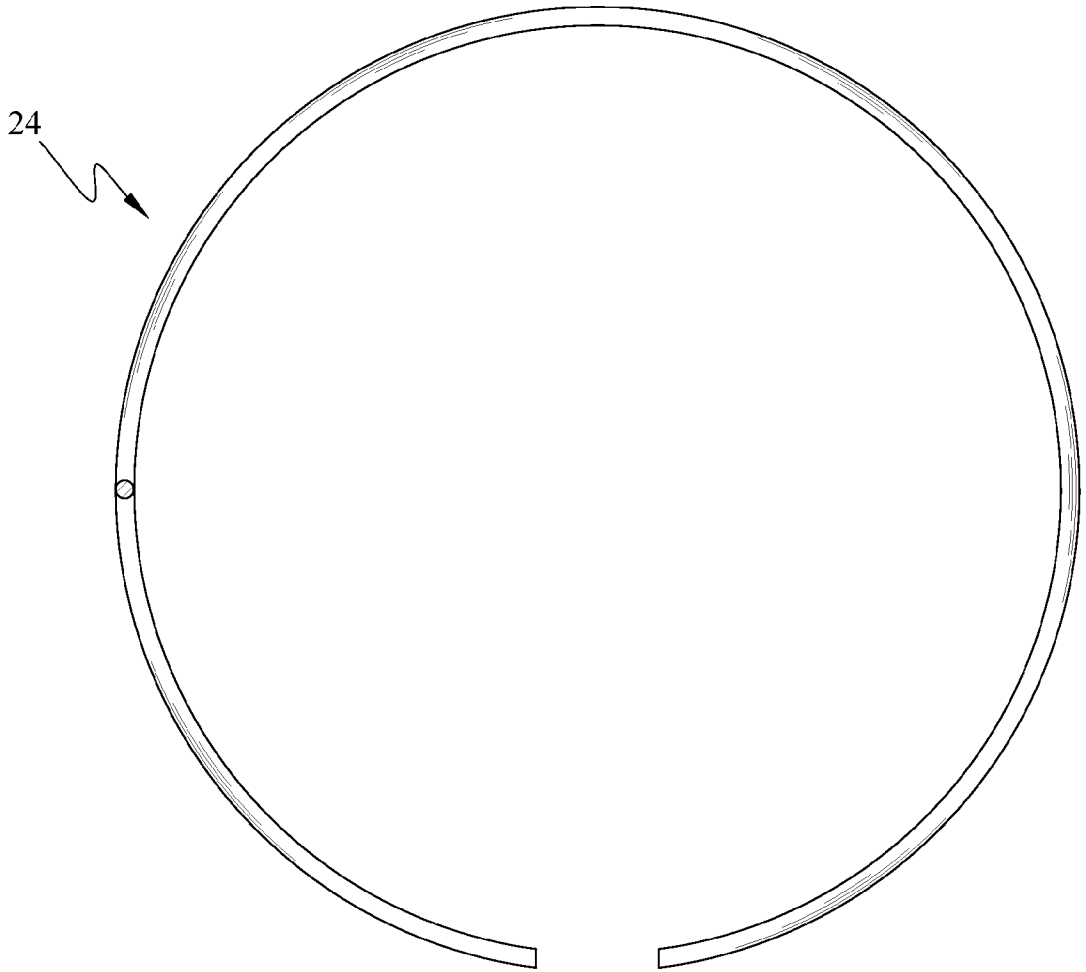
FIG. 3 is a plane view of the elastic steel ring used in the light assembly in accordance with the present invention.
Figure 4:
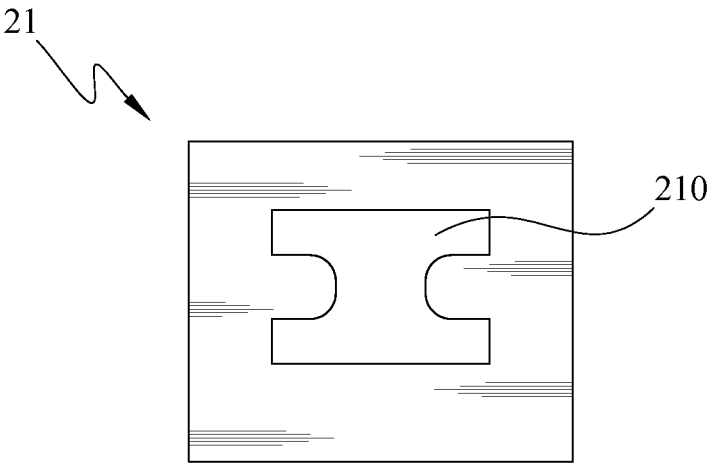
FIG. 4 is a plane view of the frame used in the light assembly in accordance with the present invention.
Figure 5:
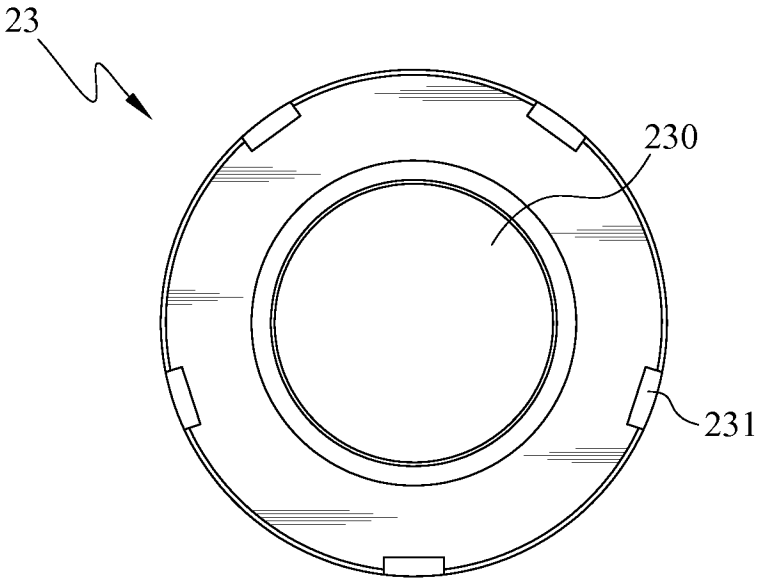
FIG. 5 is a plane view of the substrate board used in the light assembly in accordance with the present invention.
Figure 6:
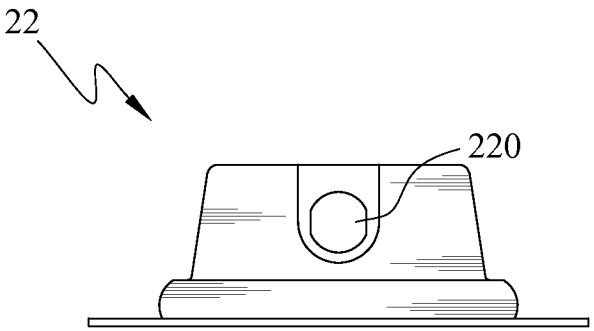
FIG. 6 is a plane view of the lamp cover used in the light assembly in accordance with the present invention.

Referring to FIG. 1, the light assembly of the present invention comprises a fixing unit 2 which is received in an inset hole in the wall (not shown), and the fixing unit 2 has a frame 21 (as shown in FIG. 4) and a plurality of torsion springs 3 (as shown in FIG. 2) are connected to the side of the frame 21. A first end of each torsion spring 3 is provided in an opening 210 in the side of the frame 21, and a second end of each torsion spring 3 is fastened to a fastener (not shown) in the inset hole in the wall. A lamp cover 22 (as shown in FIG. 6) is disposed in the frame 21 and has at least one wire hole 220 to allow the wires to pass through it. The substrate board 23 with a recessed shape is disposed at the opening of the frame 12 (as shown in FIG. 5) and has an opening 230 formed therein, and the external peripheral of the substrate board 23 has a hook flange 231. An elastic steel ring 24 (as shown in FIG. 3) is tightly fastened to the hook flange 231 of the substrate board 23 so that the substrate board 23 can be tightly fastened to the lamp cover 22.

A lighting unit 1 has at least one light source 11 disposed on the substrate 12 which is disposed in the lamp cover 22, and a reflection cup 13 is facing downwards mounted on the substrate 12, and surrounds the light source 11 so as to reflect the emitted light of the light source 11. A diffusion plate 14 is disposed on the top of the reflection cup 13 which is upside down so as to diffuse the emitted light. The diffusion plate 14 is engaged with the opening 230 of the substrate board 23 so that the substrate board 23 is held in position against the diffusion plate 14, and the reflection cup 13 is tightly fixed between the diffusion plate 14 and the lamp cover 22. Also, the substrate 12 is tightly attached to the lamp cover 22 by the pressure applied by the reflection cup 13.

Figure 7:
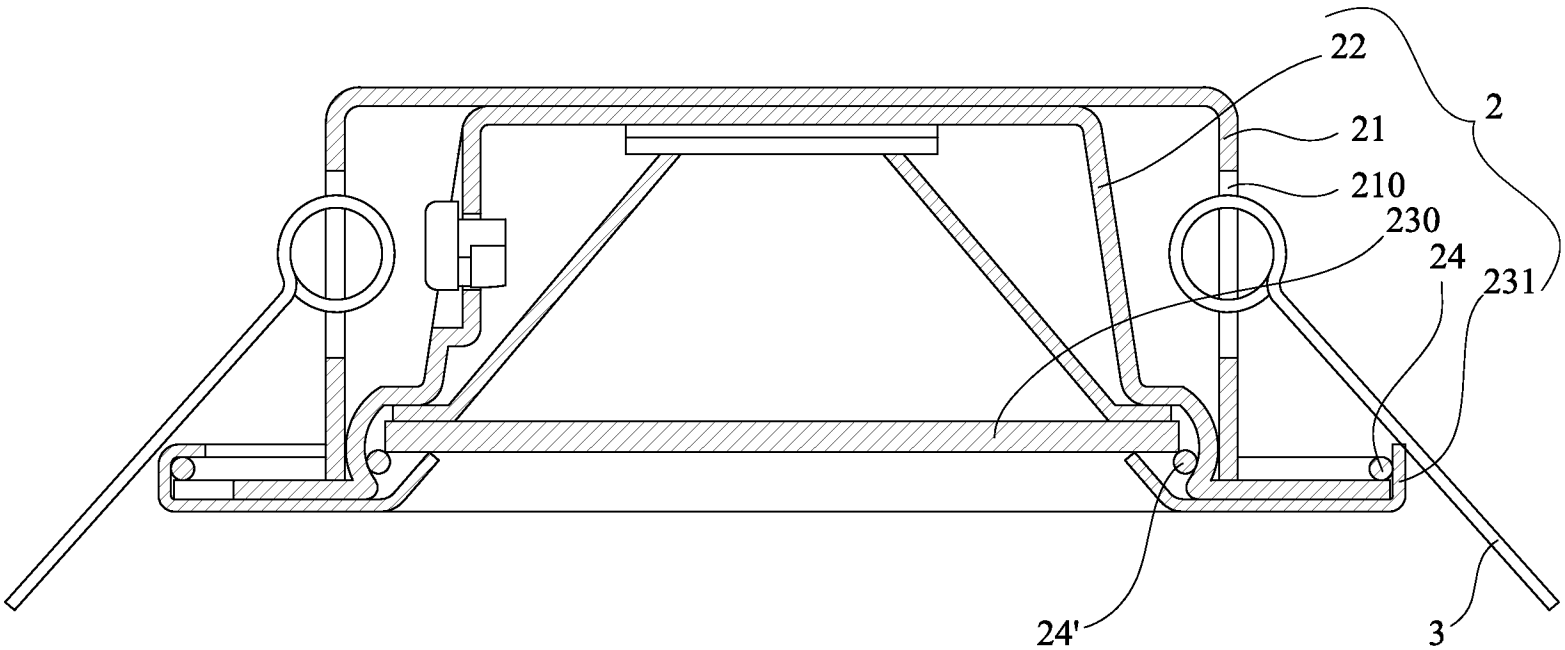
FIG. 7 is a cross sectional view of the light assembly in accordance with another embodiment of the present invention.

Another elastic steel ring 24' (as shown in FIG. 7) can be applied to the peripheral edge of the lamp cover 22 so that the lamp cover 22 can be tightly affixed to the frame 21 of the fixing unit 2.

The light source 11 is a light emitting diode (LED), and the fixing unit 2 is coated with anti-corrosion material for preventing it from being corroded by water vapor or salt mist.

The light assembly of the present invention has the following advantages:

(1) The components of the light assembly are individually installed and made by different material such as plastic or metal in view of heat dissipation characteristics thereof.

(2) The substrate board 23 with a recessed shape can avoid the light from scattering.

(3) The elastic steel ring 24 is used to secure the substrate board 23 so that the substrate board 23 will not become loose by impact or shaking The assembling process is easy and the color of the substrate board 23 can be easily changed or replaced according to the user's need.

(4) The wires are away from water vapor and salt mist to prevent wire corrosion because the wires are disposed within the lamp cover.

(5) The fixing unit is coated with anti-corrosion material (not shown) to improve the anti-corrosion performance and also the heat dissipation.

(6) The reflection cup reflects the light from the light source and applies a force to the substrate board against the lamp cover.

(7) The structure of the light assembly is air and water tight so that water vapor and salt mist are efficiently kept outside of the light assembly.

The light emitting diode is used as a light source instead of the conventional halogen lamp according to the present invention, which has the following advantages:

(1) The use life of LED is about 30000 hours which is 15 times of the use life of halogen lamps.

(2) The LED has a thickness of 2.5 cm which is one-half of that of halogen lamps. (The space in the cabin of ships is limited so that the thickness of the light assembly means a lot when it is used on ships.)

(3) The electrical power for the LED is converted from DC to AC, and then from AC to DC. There will be no energy loss during the conversion.

(4) The LED is used for energy savings and carbon reduction, and the luminous efficiency of LED is higher than that of the conventional light sources.

The light assembly of the present invention can avoid the water vapor and salt mist from entering the interior of the light assembly, and can prevent the components from being loose, and therefore it is suitably used in a ship. When used in the outside of the ship cabin, the components of the light assembly will not be corroded by the water vapor and salt mist so that the light assembly can be used for a long time. When used in the inside of the ship cabin, the light assembly with a small size does not occupy too much space. Furthermore, the light assembly structure will not become loose even when the ship is shaken. The light assembly of the present invention is also suitably used in the seaside, or the tunnels with high humidity. The light assembly of the present invention is also suitably used in the shaking environment.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A light assembly comprising:

a fixing unit comprising a frame, a plurality of torsion springs being connected to a side of the frame, a lamp cover being disposed in the frame, first elastic steel ring, a substrate board with a recessed shape disposed at an opening of the frame, the substrate board having an opening formed therein, an external peripheral of the substrate board having a hook flange, the first elastic steel ring being engaged with the hook flange of the substrate board, and a second elastic steel ring applied to a peripheral edge of the lamp cover; and a lighting unit comprising a light source, a reflection cup, and a diffusion plate, the diffusion plate being engaged with the opening of the substrate board, the substrate board being held in position against the diffusion plate, the reflection cup being tightly fixed between the diffusion plate and the lamp cover.

2. The light assembly as claimed in claim 1, wherein the light source is a light emitting diode.

3. The light assembly as claimed in claim 1, wherein the fixing unit is coated with an anti-corrosion material.

4. The light assembly as claimed in claim 1, wherein the lamp cover has at least one wire hole.

5. The light assembly as claimed in claim 1, wherein one end of each torsion spring is provided in an opening in the side of the frame.

* * * * *